US006318608B1

(12) United States Patent
Fowler et al.

(10) Patent No.: US 6,318,608 B1
(45) Date of Patent: Nov. 20, 2001

(54) CHILD CARRIER

(75) Inventors: Michael Fowler; Christopher B. Lennert, both of Longmont, CO (US)

(73) Assignee: American Recreation Products, Inc., St. Louis, MO (US)

( * ) Notice: Subject to any disclaimer, the term of this patent is extended or adjusted under 35 U.S.C. 154(b) by 0 days.

(21) Appl. No.: 09/633,534

(22) Filed: Aug. 7, 2000

Related U.S. Application Data

(60) Provisional application No. 60/148,865, filed on Aug. 13, 1999.

(51) Int. Cl.[7] ..... A61G 1/00
(52) U.S. Cl. ..... 224/161; 224/159; 224/160
(58) Field of Search ..... 224/158–161; D3/213, 214

(56) References Cited

U.S. PATENT DOCUMENTS

| | | | | |
|---|---|---|---|---|
| D. 378,017 | * | 2/1997 | Svendsen et al. | D3/214 |
| D. 394,546 | * | 5/1998 | Svendsen et al. | D3/214 |
| 2,742,212 | | 4/1956 | Siftar . | |
| 3,325,213 | | 6/1967 | Levy | 297/389 |
| 3,434,186 | | 3/1969 | Rennert | 24/191 |
| 3,686,715 | | 8/1972 | Brodnicki | 24/68 |
| 3,872,550 | | 3/1975 | Yang | 221/170 |
| 4,324,430 | | 4/1982 | Dimas, Jr. et al. | 297/250 |
| 4,343,510 | | 8/1982 | Cone | 297/250 |
| 4,376,551 | | 3/1983 | Cone | 297/250 |
| 4,416,403 | | 11/1983 | Johnson | 224/161 |
| 4,436,341 | | 3/1984 | Converse | 297/250 |
| 4,660,889 | | 4/1987 | Anthony et al. | 297/467 |
| 4,679,852 | | 7/1987 | Anthony et al. | 297/464 |
| 4,762,369 | | 8/1988 | Nicod | 297/484 |
| 4,778,091 | | 10/1988 | Barto | 224/211 |
| 4,858,997 | | 8/1989 | Shubin | 297/487 |
| 4,886,315 | | 12/1989 | Johnson | 297/250 |
| 4,912,818 | | 4/1990 | Meeker | 24/170 |
| 5,031,962 | | 7/1991 | Lee | 297/479 |
| 5,039,169 | | 8/1991 | Bougher et al. | 297/484 |
| 5,061,012 | | 10/1991 | Parker et al. | 297/467 |
| 5,160,186 | | 11/1992 | Lee | 297/479 |
| 5,222,641 | | 6/1993 | Medeiros, Jr. | 224/161 |
| 5,286,090 | | 2/1994 | Templin et al. | 297/473 |
| 5,380,066 | | 1/1995 | Wiseman et al. | 297/476 |
| 5,398,997 | | 3/1995 | McFalls | 297/476 |
| 5,427,432 | | 6/1995 | Meeker et al. | 297/256.15 |
| 5,503,461 | | 4/1996 | Schreier | 297/484 |
| 5,509,590 | | 4/1996 | Medeiros, Jr. et al. | 224/161 |
| 5,528,381 | | 6/1996 | Zhao et al. | 297/479 |

(List continued on next page.)

*Primary Examiner*—Gregory M. Vidovich
(74) *Attorney, Agent, or Firm*—Senniger, Powers, Leavitt & Roedel

(57) ABSTRACT

A child carrier for supporting a child adjacent the back of a user's torso includes a forward portion having straps engageable with the user's torso for enabling the user to tote the child carrier in a hands-free manner. A rearward portion is generally rearward of and spaced from the forward portion and a seat portion is connected generally between the forward and rearward portions for supporting a child. A child compartment is between the forward and rearward portions and defined at least in part by the seat portion. A child safety harness includes at least two shoulder straps connected to the carrier at respective first ends of the shoulder straps and positioned in the child compartment to extend over the shoulders of the child when the child is placed on the seat portion. An adjustment strap is coupled to respective second ends of the shoulder straps. An adjustment device is mounted on the carrier and has an engaged position for engaging the adjustment strap such that the shoulder straps may be tightened on the child by exerting a force only on the adjustment strap, the adjustment device inhibiting loosening of the adjustment strap and thereby inhibiting loosening of the shoulder straps on the child when the adjustment device is in the engaged position. Leg straps extend from the rearward portion toward the forward portion, the leg straps positioned to extend over at least one leg of the child.

17 Claims, 8 Drawing Sheets

U.S. PATENT DOCUMENTS

| | | | | |
|---|---|---|---|---|
| 5,580,126 | | 12/1996 | Sedlack | 297/256.15 |
| 5,609,279 | | 3/1997 | O'Shea | 224/160 |
| 5,626,271 | | 5/1997 | Messey et al. | 224/161 |
| 5,628,548 | | 5/1997 | Lacoste | 297/484 |
| 5,653,504 | | 8/1997 | Henson | 297/238 |
| 5,692,655 | * | 12/1997 | Fair et al. | 224/160 |
| 5,816,652 | | 10/1998 | Cone et al. | 297/256.15 |
| 5,868,292 | * | 2/1999 | Stephens et al. | 224/161 |
| 6,158,641 | * | 12/2000 | Eyman et al. | 224/161 X |

* cited by examiner 20
30
64
24
28
70
66
36
38
26
52
54
112
82
60
22
144
116
114
32
48
44
46
84
84
88
34
88
80
90
86
90

120
4
30
24
28
75
76
70
72
68
38
36
62
74
82
56
4
73
116
42
48
114
40
80
90
34

144
147
146
149
154
164
160
B
114

144
147
146
149
156
154
164
116
114

144
114
112
146
166
151
156
149
154
164
116
114
157
62
62

CHILD CARRIER

CROSS REFERENCE TO RELATED APPLICATION

This patent claims priority from U.S. Provisional Application Serial No. 60/148,865. Filed Aug. 13, 1999.

BACKGROUND OF THE INVENTION

The present invention relates generally to child carriers for supporting a child in a child compartment adjacent the back of a hiker, and more particularly to a child carrier having an adjustable five point child safety harness for securing the child in the child compartment.

A conventional child carrier has a forward portion with shoulder straps and a waist strap for holding the child carrier on the back of a hiker. A child compartment having a seat portion for supporting the child is positioned rearward of the forward portion. Some older model child carriers included no means for holding the child in the compartment. Later model child carriers include a shoulder harness and/or a simple lap belt to prevent the child from falling (or climbing) out of the carrier.

However, some later model child carrier harnesses and lap belts have proven deficient under real world conditions. It has been reported with regard to recent recalls of some child carriers that certain harnesses and/or lap belts do not always prevent the child from wriggling out of the child compartment. The prior art harnesses and lap belts are often difficult to properly tighten against the child, which is due in part to the difficulty of adjusting straps inside the child compartment while the child is in the carrier. Where the harness and/or lap belt are not properly used, there is a serious risk that the child may wriggle out of the child compartment and fall to the ground.

SUMMARY OF THE INVENTION

Among the several objects of the present invention may be noted the provision of an improved child carrier having a child safety harness that reliably secures a child in the carrier; the provision of such a carrier that does not require tightening of straps inside a child compartment of the child carrier while the child is in the compartment; and the provision of such a carrier having a simplified arrangement for tightening the harness on the child.

Briefly, the present invention is directed to a child carrier for supporting a child adjacent the back of a hiker's torso. The carrier comprises a forward portion having straps engageable with the hiker's torso for enabling the hiker to tote the child carrier in a hands-free manner. The carrier further comprises a rearward portion generally rearward of and spaced from the forward portion, a seat portion connected generally between the forward and rearward portions for supporting a child, and a child compartment between the forward and rearward portions and defined at least in part by the seat portion. The carrier includes a child safety harness comprising at least two shoulder straps attached to the carrier at respective first ends of the shoulder straps and positioned in the child compartment to extend over the shoulders of the child when the child is placed on the seat portion. An adjustment strap is coupled to respective second ends of the shoulder straps. An adjustment device is mounted on the carrier and has an engaged position for engaging the adjustment strap such that the shoulder straps may be tightened on the child by exerting a force only on the adjustment strap. The adjustment device inhibits loosening of the adjustment strap and thereby inhibits loosening of the shoulder straps on the child when the adjustment device is in the engaged position. Leg straps extend from the rearward portion of the carrier toward its forward portion and are positioned to extend over at least one leg of the child.

In another aspect of the invention, the child carrier comprises the forward portion as described above, and the rearward portion. In this aspect, the rearward portion includes an inverted U-shape frame member and a cross member extending generally between the legs of the frame member. The carrier further comprises the seat portion and the child compartment as described above. The child safety harness of this aspect comprises said at least two shoulder straps, the adjustment strap and the adjustment device. The cross member is positioned below the seat portion and mounts the adjustment device.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
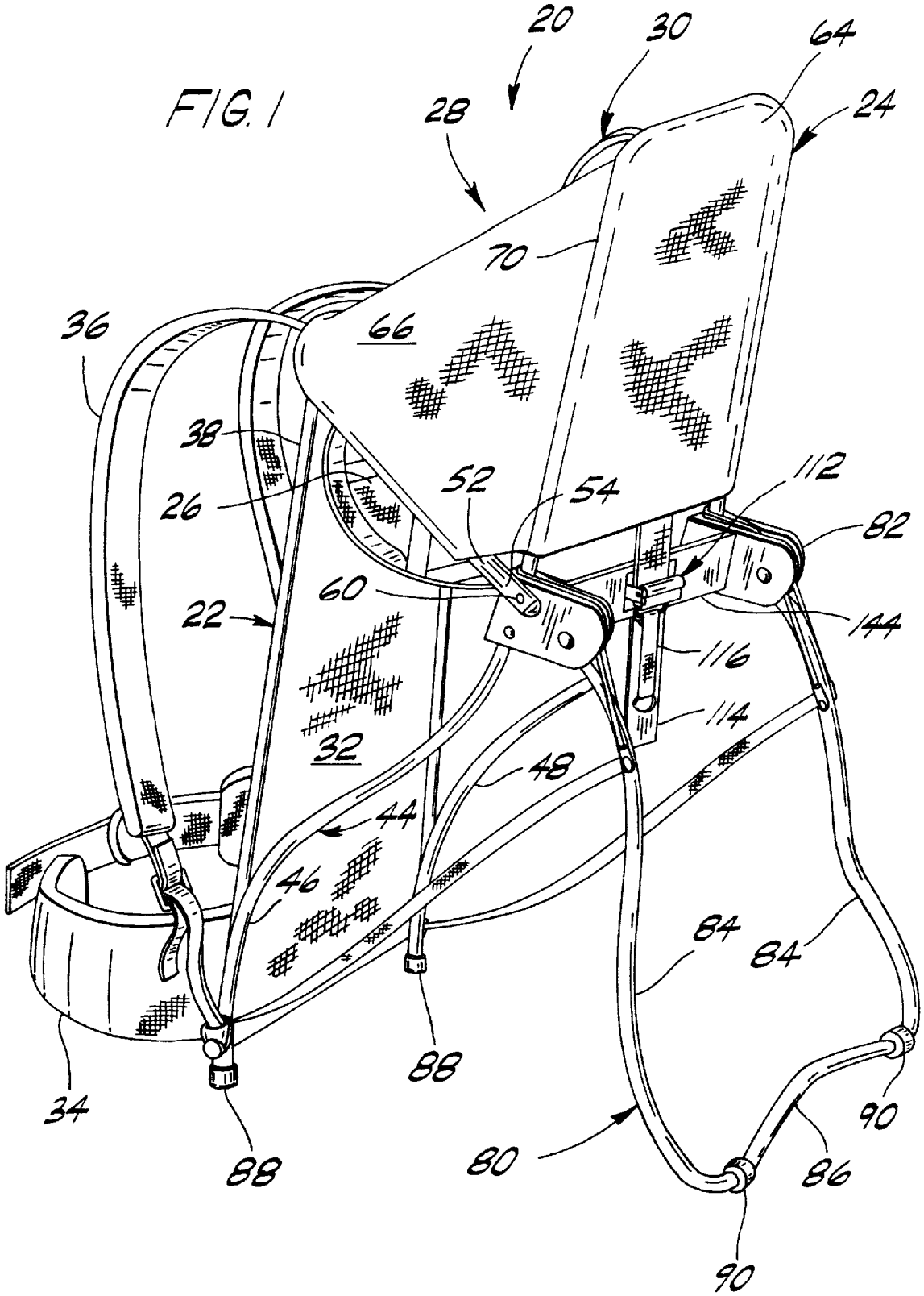
FIG. 1 is a perspective view of a child carrier of this invention.
Figure 2:
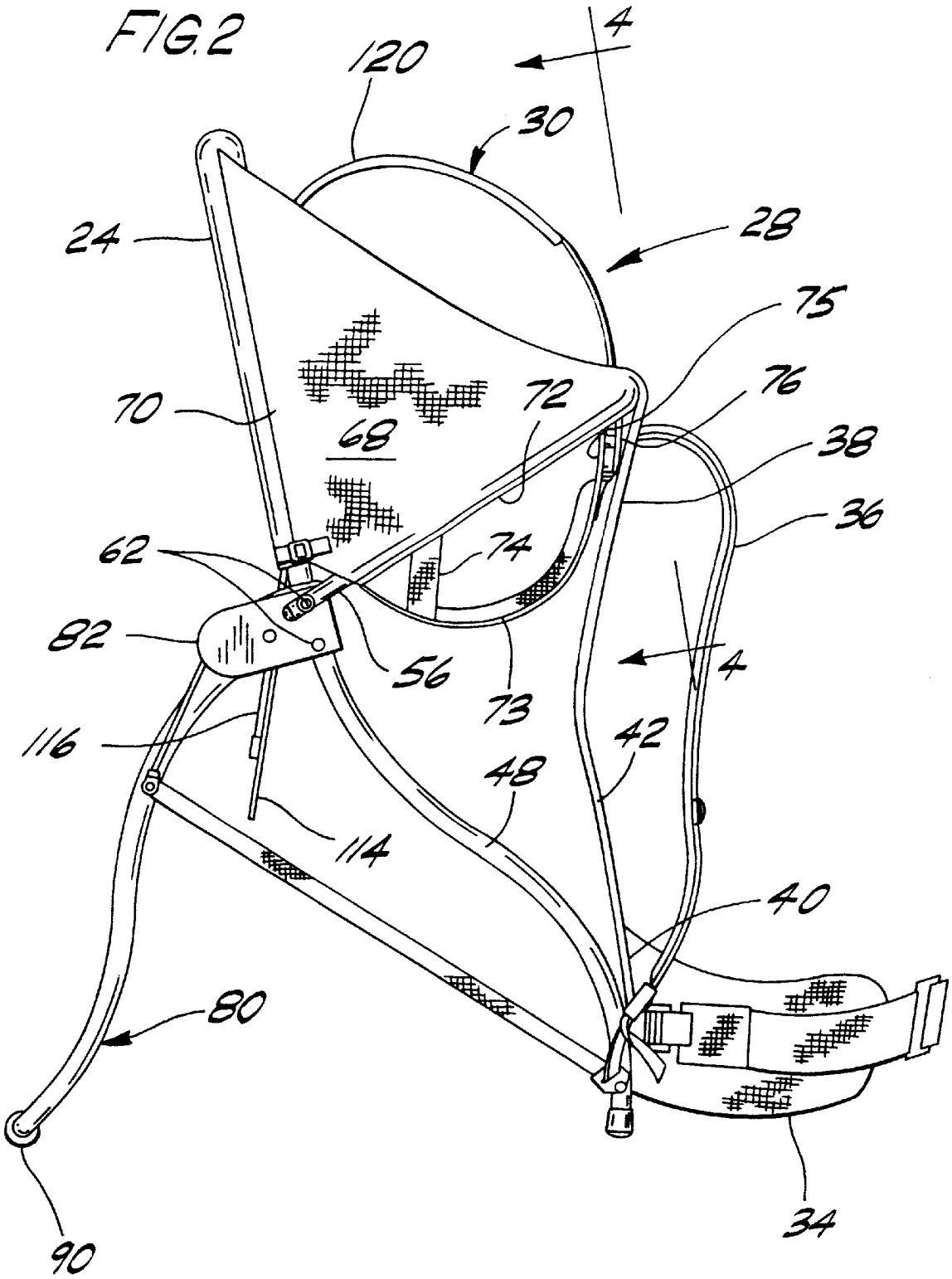
FIG. 2 is a side elevation of the child carrier with a kickstand of the child carrier pivoted to a propping position.
Figure 3:
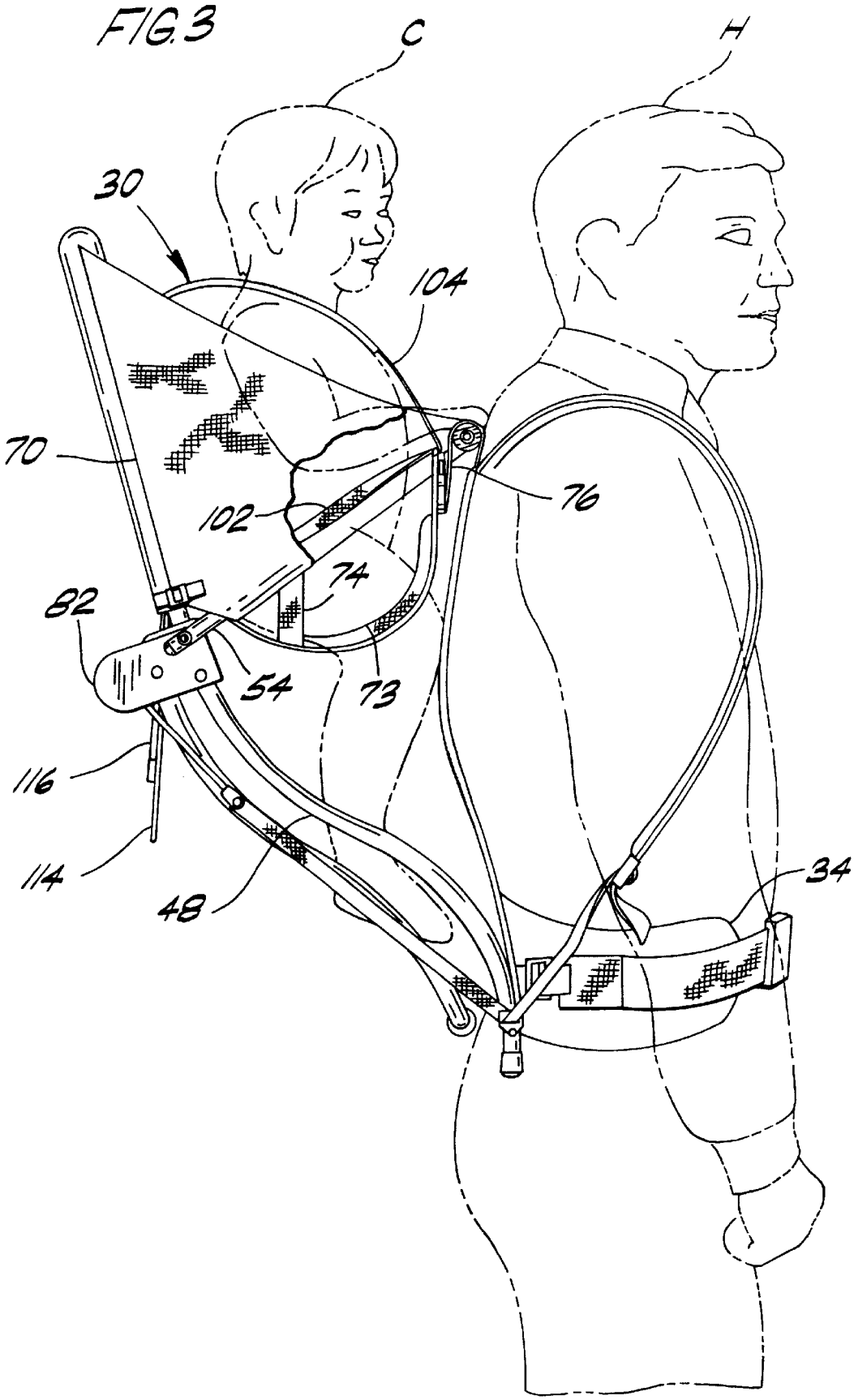
FIG. 3 is a side elevation of the carrier with the kickstand pivoted to a retracted position and with a hiker and child shown in phantom.

Referring now to the drawings, and in particular to FIGS. 1–3, a child carrier is indicated in its entirety by the reference numeral 20. The child carrier 20 is adapted for supporting a child C (FIG. 3) adjacent the back of a hiker H (generally, user). It comprises a forward portion, generally indicated at 22, a rearward portion, generally indicated at 24, a child seat portion 26, a child compartment, generally indicated at 28, between the forward and rearward portions, and a child safety harness, generally indicated at 30, for securing the child in the child compartment.

The forward portion 22 comprises a forward member 32, an adjustable waist strap (belt) 34, and a pair of adjustable shoulder straps indicated at 36. The forward member 32 is preferably formed of multiple sheets of flexible material with padding therebetween joined together as by stitching and is adapted for conforming to and abutting the back of the hiker's torso. It includes an upper region 38 (FIG. 2) engageable with the upper back of a hiker H wearing the child carrier 20, a lower region 40 adjacent the lower back of the hiker, and an intermediate region 42 extending between the upper and lower regions. The waist strap 34 is attached to the lower region 40 of the forward member 32 of the carrier for engaging the waist of the hiker H. The two shoulder straps 36 are secured to the upper region 38 of the forward member 32 for engaging the shoulders of the hiker H. The intermediate region 42 of the forward member 32 comprises a nylon mesh material for permitting the back of the hiker H to breath. As shown in FIG. 3, the waist strap 34 and shoulder straps 36 enable the hiker H to tote the child carrier 20 in a hands-free manner. It is to be noted that the forward member may be otherwise constructed within the scope of this invention.

Figure 4:
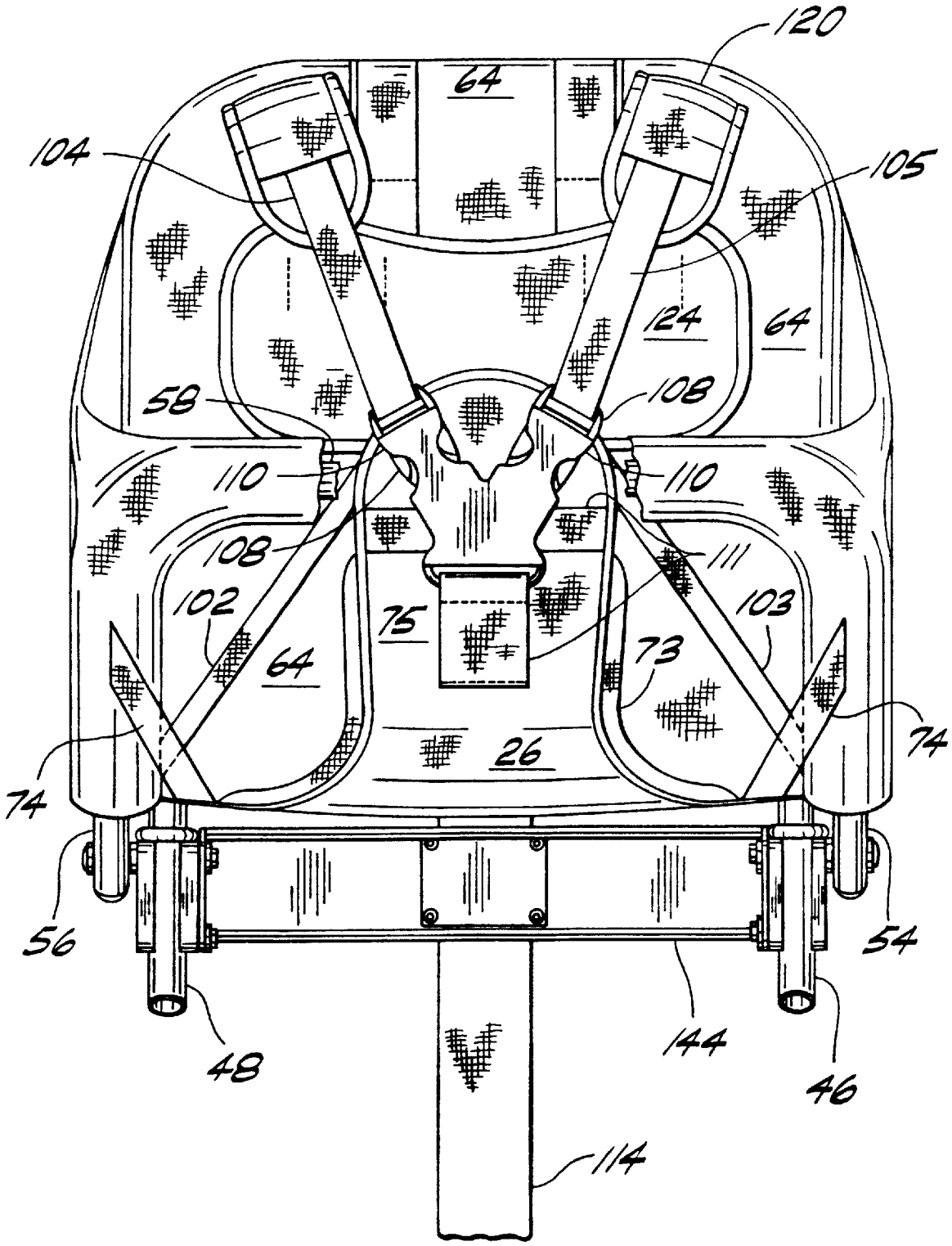
FIG. 4 is a fragmentary section taken along the plane of line 4—4 of FIG. 2, a forward member is omitted for clarity.
Figure 5:
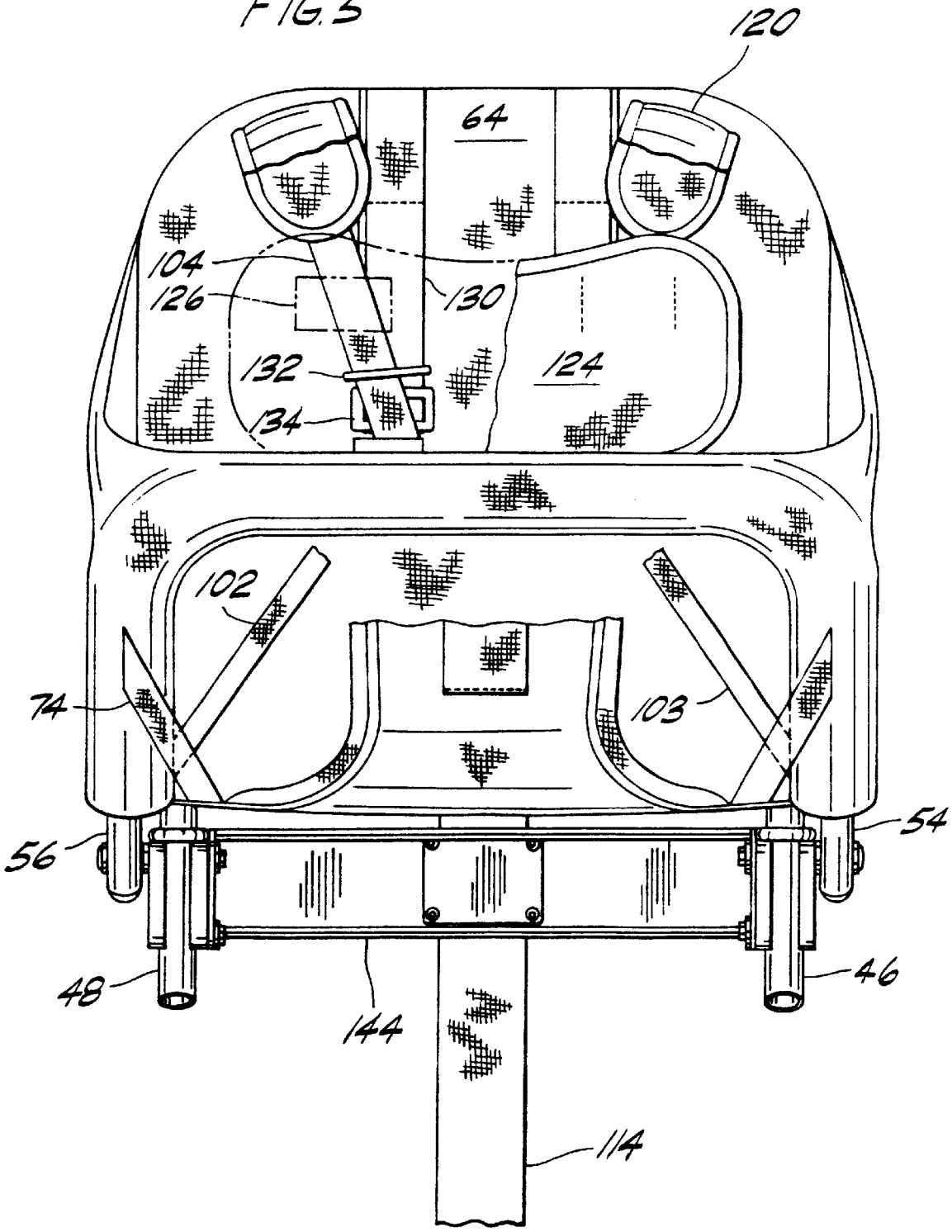
FIG. 5 is a fragmentary section similar to FIG. 4 but with portions broken away to show details.

The carrier is supported by a main frame member, generally designated 44, preferably comprising a length of tubular bar stock bent into the shape of an inverted U to have left and right leg portions 46, 48 and a curved central portion 50 (FIG. 6) adjacent a rear of the child compartment 28. The frame member 44 slopes generally upward and rearward from the lower region 40 of the forward member 32 of the carrier to the upper end of the rearward portion 24 of the carrier. The waist strap 34 is connected to the left and right leg portions 46, 48 of the frame member adjacent their lower ends. A U-shaped support 52, also preferably of tubular bar stock, extends forward and upward from the main frame member to define opposite sides and the front of the child compartment 28. The support 52 comprises left and right side bars 54, 56 and a generally horizontal front bar 58 (FIG. 4). The left and right side bars 54, 56 are pivotally connected to upper regions of the leg portions 46, 48 of the main frame member 44 via bolts 60, 62 (generally, pin-connections). The upper region 38 of the forward member 32 of the carrier is secured to the horizontal front bar 58 in suitable fashion, such as by adjustable straps (not shown), to hold the forward portion 72 of the carrier erect. Preferably, the main frame member 44 and support 52 are formed of a durable, lightweight tubing such as aluminum. Preferably, hollow core foam padding 63 is fitted around the tubing.

A slip-on, back-support cover 64 of flexible material having an open bottom is positioned over the upper end of the main frame member 44. The curved central portion 50 and spaced-apart leg portions 46, 48 of the main frame member 44 maintain the cover 64 in a taut configuration for supporting the back of the child C seated in the child compartment 28. The back-support cover 64 and upper end of the main frame member 44 combine to form the rearward portion 24 of the child carrier 20. The sides of the child compartment 28 are closed by left and right side walls 66, 68. Each wall is preferably fabricated as a pair of parallel flexible panels seamed along their rear margins 70 to the back-support cover 64, along their top margins to one another, and along their front margins 72 to one another forward of a respective side bar 54, 56 of the U-support 52. The walls 66, 68 of the child compartment 28 are held taut between the back-support cover 64 and side bars 54, 56.

The rear of the child seat portion 26 is attached to and depends from a bottom edge margin (not shown) of the back-support cover 64. Preferably elastic straps 74 extend between the left and right side walls 66, 68 and side edge margins 73 of the seat portion 26 to further support the weight of the child. The seat portion 26 includes a forwardly extending crotch section 75 attached to the forward portion 22 of the carrier as by a strap 76. For example, the strap 76 may be attached to the forward portion 22 by a conventional adjustable connector and strap (not shown) of the forward portion so that the seat portion 26 is adjustable vertically relative to the forward member. Preferably, the seat portion includes padding along its side edge margins 73 for gently supporting the child's legs. The back-support cover 64, side walls 66, 68, and child seat portion 26 define the child compartment 28. Preferably, the back-support cover 64, side walls 66, 68, and seat portion 26 are of a suitable lightweight, flexible material such as a nylon "ripstop" material. It is to be understood that the back-support cover 64, side walls 66, 68, and seat portion 26 may be formed of a single unitary sheet of material but are preferably formed from multiple sheets of material joined together as by stitching. It is further to be understood that a hood may be included on the carrier as described in co-assigned U.S. Pat. No. 5,609,279, which is incorporated herein by reference.

A kickstand, generally indicated at 80, preferably formed of aluminum tubing, is connected to the main frame member 44 via suitable hinges, each generally indicated at 82, for pivotal movement of the kickstand about an axis X. The preferred kickstand is more fully described in U.S. Pat. No. 5,626,279, which is incorporated herein by reference, and will therefore be described only briefly herein. The kickstand 80 is generally U-shaped as viewed from the rear (see FIG. 1) and has two side portions 84 extending down from the hinges 82 and a ground-engageable portion 86 extending between lower ends of the side portions. The kickstand 80 is moveable between a retracted position (FIG. 3) and a propping position (FIGS. 1 and 2). In the retracted position, the ground-engageable portion 86 (i.e., the lower portion) of the kickstand 80 is positioned generally adjacent the main frame member 44. In the propping position, the ground-engageable portion 86 of the kickstand 80 is positioned away from the main frame member 44 (i.e., to the left of the main frame member as viewed in FIG. 2) for engaging a generally horizontal surface, such as a floor or ground (not shown), to prop the child carrier 20 in a generally upright position on the surface when the child carrier is not being worn by the hiker H. Preferably, front feet 88 are positioned on lower ends of the leg portions 46, 48, and rear feet 90 are positioned on the ground-engageable portion 86 of the kickstand 80 for engagement with the surface.

Referring to FIGS. 2–6, the child safety harness 30 generally comprises right and left leg straps 102, 103 and right and left shoulder straps 104, 105 slidably connected via respective male connectors 108 and female connectors 110 to the crotch section 75 of the seat portion 26. The child safety harness is a "five-point harness", i.e., a harness having five straps or members connected adjacent the crotch, mid-section or chest of the child. In this embodiment, the five straps or members are the two shoulder straps 104, 105, the two leg straps 102, 103 and the crotch section, all of which are connected adjacent the crotch of the child.

An adjustment device generally indicated at 112 has an engaged position (FIG. 7) for engaging an adjustment strap 114 which is coupled to the shoulder straps 104, 105 for tightening the shoulder straps on the child C and for inhibiting loosening of the shoulder straps. The adjustment device 112 includes a release strap 116 for moving the adjustment device to its released position (FIG. 8) to release the adjustment strap 114 so that the shoulder straps 104, 105 may be loosened.

Referring to FIGS. 3–6, the right leg strap 102 and right shoulder strap 104 will be described hereinafter. It is to be understood that the left leg strap 103 and left shoulder strap 105 are substantially identical. The right leg strap 102 is fixedly attached at a first end to the back support cover 64. Preferably, the leg strap 102 is sewn into the seam between the back support cover and the right side wall 68. The leg strap extends toward the center of the child compartment 28 and toward the forward portion 22 when it is connected to the crotch section 75. The leg strap 102 and the shoulder strap 104 are preferably formed as one piece of continuous webbing material. It is to be understood that the leg strap and the shoulder strap may be formed separately within the scope of this invention. The male connector 108 is slidably received on the piece of continuous material, the leg strap 102 being defined by the portion of the continuous material extending over the leg of the child C from the seam 71 to the crotch section 75, and the shoulder strap being defined by the portion of the material extending from the male connector over the shoulders of the child when the child is placed on the seat portion 26. In this embodiment, the shoulder strap 104 and leg strap 102 share the same male connector 108, but separate connectors may be used within the scope of this invention.

Each female connector 110 is fixedly attached to the crotch section 75, as by straps 111, and releasably secures one of the male connectors 108 to the seat portion 26. Preferably, the male connectors 108 and female connectors 110 are conventional buckles, such as those available from Woo Jin under the DURAFLEX™ brand name, in which the male connectors have flexibly resilient spring fingers which have a snap-in releasable connection with respective female connectors. More preferably, the two female connectors 110 are formed as an integral, one-piece Y-shaped buckle, as shown in FIG. 4.

A shoulder pad 120 is slidably mounted on each shoulder strap 104 to contact the shoulder of the child C. The shoulder straps 104 extend down from the child's shoulder behind the upper back of the child. A generally rectangular back pad 124 is preferably slidably mounted on the shoulder straps 104, 105 in a position in which it spans the two straps. The shoulder straps extend through vertical sleeves 126 defined by strips (one of which is shown in phantom in FIG. 5) attached to the rear surface of the pad so that the back pad is slidably adjustable along the straps. The vertical position or height of the back pad 124 is also adjustable by an arrangement comprising a pair of vertical pad adjustment bands 130 attached at their upper and lower ends to the back support cover 64. The bands 130 are spaced apart a distance corresponding to the spacing between the shoulder straps. A pair of rigid loops 132 are slidably mounted on each band 130 and receive respective shoulder straps 104, 105 therethrough. (The shoulder straps extend in front of the band 130.) The loops are held in the desired vertical position by adjustment members comprising a pair of slide buckles 134 slidable on the bands 130 to selected positions. The slide buckles 134 serve to inhibit the downward movement of the loops 132 on the band. When positioned, the loops 132 are engageable by the sleeves 126 on the back pad 124 to hold the pad at the proper height.

Figure 6:
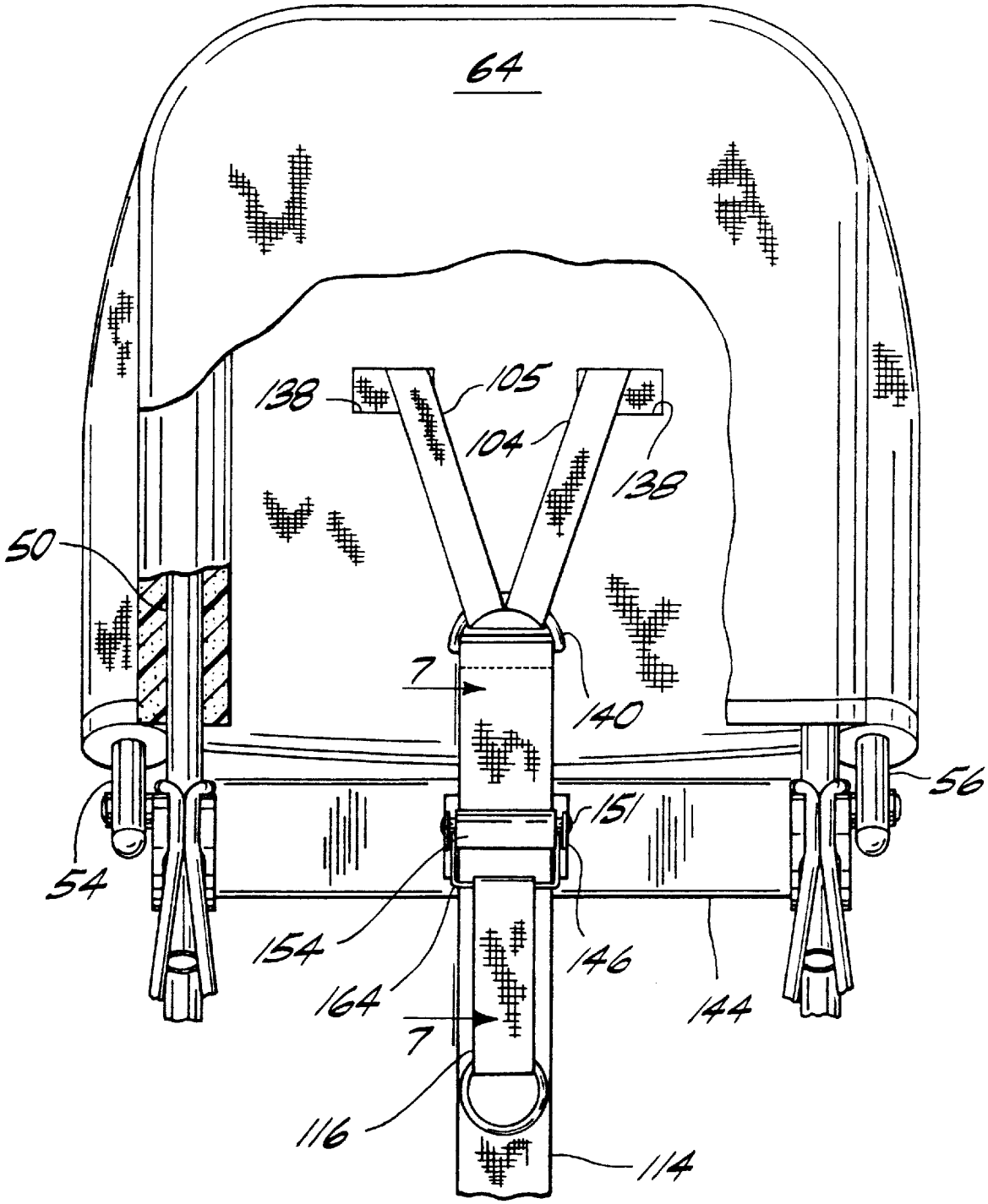
FIG. 6 is a fragmentary rear elevation of the carrier with portions of a back support pouch cut away to show an adjustment device.

The shoulder straps 104 extend further down from the back pad 124 through openings 138 in a front panel of the back support cover 64 and terminate at a coupling 140 which connects the shoulder straps 104, 105 with the adjustment strap 114. As shown in FIG. 6, the adjustment strap extends down from the coupling 140 through the adjustment device 112.

Referring to FIGS. 1 and 6–9, the adjustment device 112 is mounted on a cross member 144 which extends generally between the left and right leg portions 46, 48 of the main frame member 44 at a position generally below the seat portion 26. Preferably, the cross member 144 is attached to the hinges 82, as by bolts 60, 62 and mating nuts 145, and is formed of aluminum plate. The adjustment device 112 comprises a bracket 146 having a generally planar surface 147, and arms 149 extending rearward from the planar surface. Preferably the bracket 146 is made of zinc plated steel. The bracket 146 is mounted on the cross member 144, as by rivets 150 (shown in FIG. 4), such that the arms 149 are oriented in generally parallel vertical planes. Each arm has a hole therethrough which receives an elongate bolt or rod 151 that is fixedly secured to the arms. A rotatable member or cam 154 and a coil spring 156 (shown in dashed lines) are mounted on the rod 151 such that a space is defined between the cam and the surface 147 of the bracket 146 through which the adjustment strap 114 extends. Preferably, the rod 151 is made of zinc plated brass, the cam 154 is made of aluminum and the spring 156 is made of stainless steel. The spring 156 is attached at one end to the rod 152 and at its other end to the cam 154 such that the spring biases the cam to rotate clockwise (as viewed in FIGS. 7–8) toward an engaged position. In this position the adjustment strap 114 is forced by the cam 154 against the surface 147 of the bracket 146 so that the adjustment strap can only be tightened, that is, pulled down in the direction of arrow 157. The cam 154 preferably includes teeth 160 which engage the adjustment strap 114. The teeth 160 have points extending generally downward when the cam 154 is in its engaged position. Due to the orientation of the teeth 160 (generally downward) and the direction in which the spring 156 biases the cam (in a direction toward surface 147), the teeth force the adjustment strap 114 against the planar surface 147 so that the adjustment strap is substantially secured against movement in an upward direction, while allowing the adjustment strap to be pulled in the downward direction of arrow 157. This arrangement allows the shoulder straps 104, 105 to be tightened against the child C simply by pulling down on the adjustment strap 114 but does not allow the adjustment strap to move upward. This arrangement further ensures that the shoulder straps 104, 105 and leg straps 102, 103 remain tight against the child, even in the event the child is forced abruptly forward against the shoulder straps or leg straps. In such an event, the cam 154 may rotate further clockwise as viewed in FIG. 7 so that more teeth 160 engage the adjustment strap 114.

Figures 7, 8, 9:
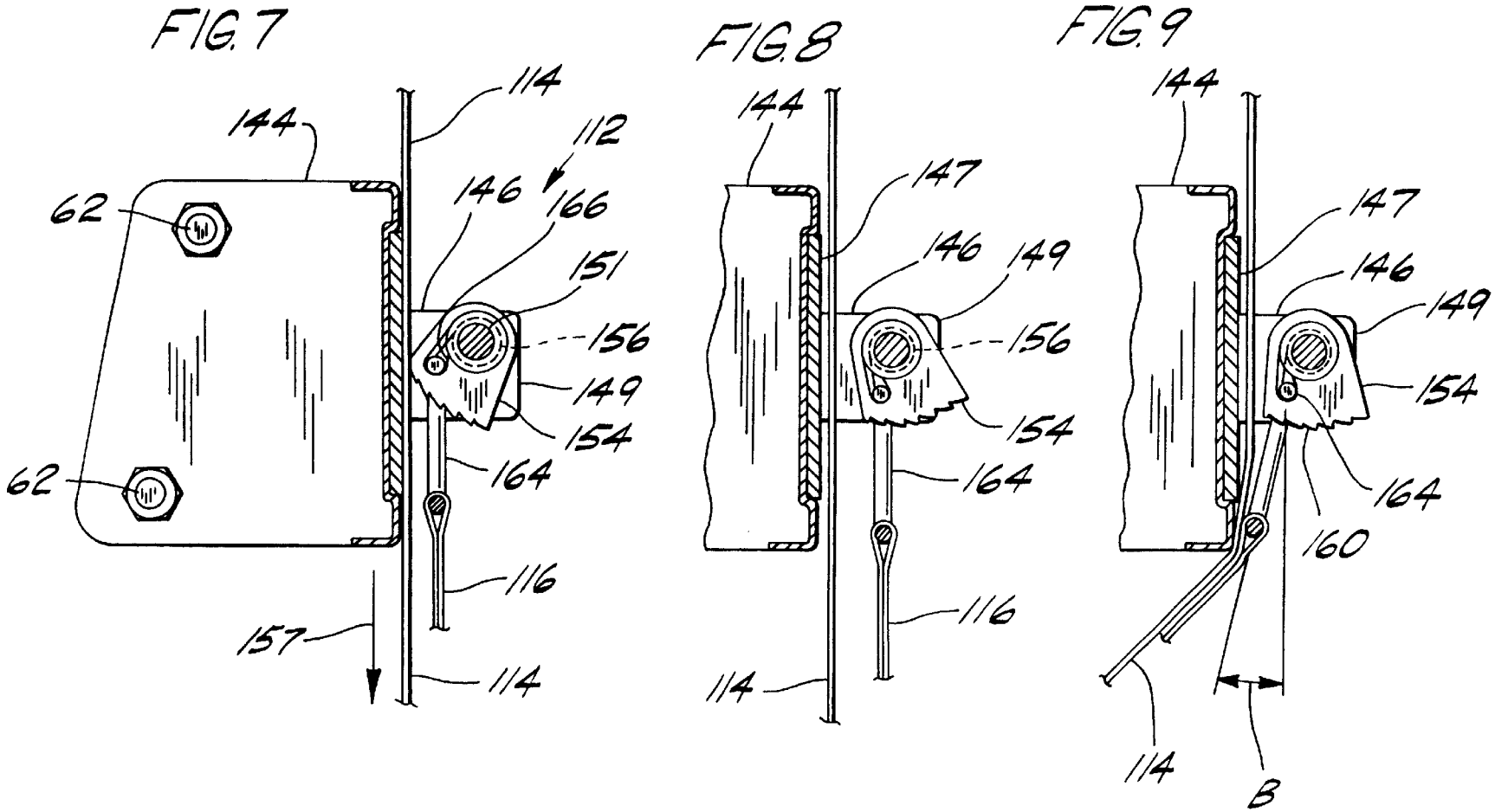
FIG. 7 is a fragmentary section taken along the plane of line 7–7 of FIG. 6 showing the adjustment device in an engaged position.
FIG. 8 is a fragmentary section similar to FIG. 7 but showing the adjustment device in its released position.
FIG. 9 is a fragmentary section similar to FIG. 8 showing a bail of the adjustment device positioned at a predetermined minimum angle.

The adjustment device 112 has a released position (see FIGS. 8–9) in which the teeth 160 of the cam 154 do not engage the adjustment strap 114 thereby to allow the adjustment strap to be pulled upward. The adjustment device 112 includes a bail 164 received in openings 166 at opposite ends of the cam 154. Release strap 116 is attached to the bail. Preferably, the bail 164 is made of stainless steel wire and the release strap 116 is made of webbing material. Preferably, the arrangement of the openings 166, the bail 164, the bracket 146 and the cross member 144 is such that a pulling force exerted on the release strap in substantially any direction moves the cam to the release position. Typically, the bail will be pulled downward or rearward by the hiker H. However, in some cases, the hiker H may be in an awkward position and need to pull the release strap generally forward. In this embodiment, the bail 164 may be pulled forward to contact the bracket 146 or the cross member 144 (see FIG. 9) at some predetermined minimum angle B from vertical. A pulling force on the cam 154 at this predetermined minimum angle B causes the cam to rotate sufficiently so that the teeth 160 disengage and release the adjustment strap 114. As will be apparent to those skilled in the art, the cam 154 will tend to rotate until the direction of pulling force is generally coplanar with the axis of the rod 152. Thus, even when the release strap 116 is pulled forward at an angle from vertical that is greater than the predetermined angle B, as shown in FIG. 9, the bracket 146 or cross member 144 prevents further forward movement of the bail 164 and the force exerted on the cam 154 is still directed along the predetermined minimum angle, causing the adjustment strap 114 to be released.

In operation, the harness 30 is loosened by pulling the release strap 116 with one hand to disengage the cam 154 from the adjustment strap 114, and by pulling both shoulder straps 104, 105 simultaneously with the other hand. This operation loosens both the shoulder straps and the leg straps 102, 103 so that the child C may be easily positioned on the seat portion. The male connectors 108 are then mated with the female connectors 110 at the crotch section 75 of the seat portion 26. It is to be noted that only two connections are required in the preferred embodiment of this invention, both connections being located at or adjacent the crotch section 75 so that they are easily accessible by the hiker H after the child C is placed in the child compartment. The adjustment strap 114, which advantageously hangs down below the child compartment 28, is pulled downward until the shoulder straps 104, 105 and leg straps 102, 103 fit snugly against the child C.

Figure 11:
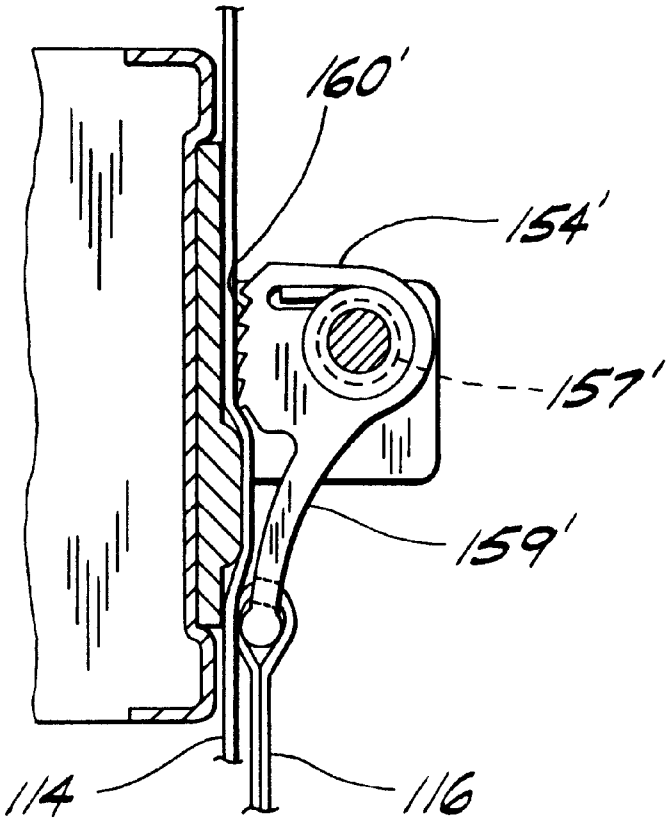
FIG. 11 is a fragmentary section similar to FIG. 7 but showing the second embodiment of the adjustment device in a second engaged position.
Figure 10:
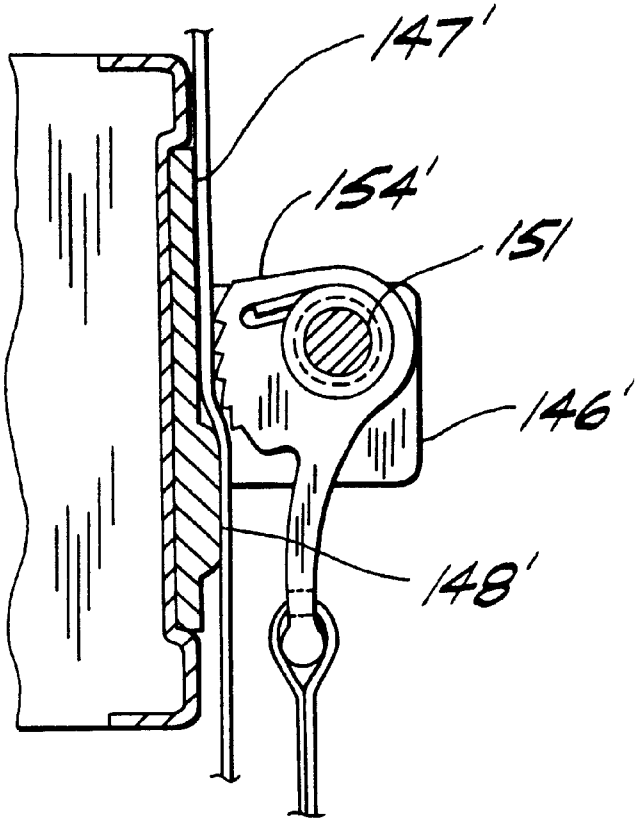
FIG. 10 is a fragmentary section similar to FIG. 7 but showing a second embodiment of the adjustment device in a first engaged position.

In a second embodiment of the adjustment device, shown in FIGS. 10 and 11, a bracket 146' includes a surface 147' having an upraised rib 148' protruding from the surface. The rib is positioned generally parallel to and downward from the rod 151 (as viewed in FIG. 10). A rotatable member or cam 154' and a coil spring 157' (shown in dashed lines) are mounted on the rod 151 such that a space is defined between the cam and the surface 147' of the bracket 146' through which the adjustment strap 114 extends. The cam 147' includes a lever 159' formed as one piece with the cam and extending downward from the cam as viewed in FIG. 10. The release strap 116 is attached directly to the lever 159' through a slot formed therethrough. The cam is movable to the released position by pulling the release strap 116 in a direction generally rearward from the surface 147'. The spring 157' is attached as described above such that the spring biases the cam to rotate clockwise (as viewed in FIGS. 10, 11) toward an engaged position. In the engaged position, the cam 154' forces the adjustment strap 114 against the surface 147' of the bracket 146' so that the adjustment strap can only be pulled downward to tighten the shoulder straps 104, 105. The cam 154' preferably includes teeth 160' which engage the adjustment strap 114 and are constructed as described above. As shown in FIG. 10, the adjustment strap 114 is engaged by the teeth 160' and pressed against a flat portion of the surface 147' upward from the rib 148'. If the child C is forced abruptly against the shoulder straps 104, 105, the cam 154' rotates upward (clockwise in FIGS. 10 and 11). This rotation causes the teeth to move farther away from the rib 147' as shown in FIG. 11, such that more teeth 160' engage the adjustment strap 114 and the adjustment strap is thereby more securely held.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A child carrier for supporting a child adjacent the back of a user's torso comprising:

a forward portion having straps engageable with the user's torso for enabling the user to tote the child carrier in a hands-free manner;

a rearward portion generally rearward of and spaced from the forward portion;

a seat portion connected generally between the forward and rearward portions for supporting a child;

a child compartment between the forward and rearward portions and defined at least in part by the seat portion;

a child safety harness comprising:

at least two shoulder straps connected to the carrier at respective first ends of the shoulder straps and positioned in the child compartment to extend over the shoulders of the child when the child is placed on the seat portion;

an adjustment strap coupled to respective second ends of the shoulder straps;

an adjustment device mounted on the carrier and having an engaged position for engaging the adjustment strap such that the shoulder straps may be tightened on the child by exerting a force on the adjustment strap, the adjustment device inhibiting loosening of the adjustment strap and thereby inhibiting loosening of the shoulder straps on the child when the adjustment device is in the engaged position; and leg straps extending from the rearward portion toward the forward portion and positioned to extend over at least one leg of the child.

2. A child carrier as set forth in claim 1 wherein the adjustment device includes a release strap connected to the adjustment device and movable to release the adjustment strap from engagement with the adjustment device for loosening the shoulder straps.

3. A child carrier as set forth in claim 1 wherein one of said shoulder straps and one of said leg straps are formed as one piece of continuous material, the respective straps being slidably attached to the seat portion by a connector.

4. A child carrier as set forth in claim 3 wherein the adjustment device includes a release strap connected to the adjustment device and movable to release the adjustment strap from engagement with the adjustment device for loosening the shoulder straps and the leg straps simultaneously.

5. A child carrier as set forth in claim 4 wherein the adjustment strap and the release strap extend down and away from the child compartment such that they are accessible from outside the child compartment.

6. A child carrier as set forth in claim 1 wherein the adjustment device includes a rotatable member having teeth thereon for engaging the adjustment strap when the adjustment device is in the engaged position to substantially secure the adjustment strap against movement in an upward direction and thereby prevent loosening of the shoulder straps, while allowing movement of the adjustment strap in a downward direction for allowing the shoulder straps to be tightened against the child, the adjustment device further having a released position in which the teeth are not engaged with the adjustment strap to allow movement in the upward direction and thereby allow loosening of the shoulder straps.

7. A child carrier as set forth in claim 6 wherein the adjustment strap contacts a surface when in the engaged position, the surface having a rib protruding therefrom, and in the event the child is forced abruptly against the shoulder straps, the rotatable member being capable of rotation such that more of the teeth engage the adjustment strap and such that the teeth move farther away from the rib.

8. A child carrier as set forth in claim 6 wherein the adjustment device includes a spring biasing the rotatable member toward the engaged position.

9. A child carrier as set forth in claim 1 wherein the rearward portion comprises:

an inverted U-shape frame member having downwardly extending legs, a cross member mounting the adjustment device extending generally between the legs of the frame member and positioned downward from the seat portion, the adjustment strap and release strap extending down and away from the adjustment device so that the adjustment strap and release strap are easily accessed by the user.

10. A child carrier for supporting a child adjacent the back of a user's torso comprising:

a forward portion having straps engageable with the user's torso for enabling the user to tote the child carrier in a hands-free manner;

a rearward portion including an inverted U-shape frame member generally rearward of and spaced from the forward portion, a cross member extending generally between the legs of the frame member;

a seat portion connected generally between the forward and rearward portions for supporting a child;

a child compartment between the forward and rearward portions and defined at least in part by the seat portion;

a child safety harness comprising:

at least two shoulder straps connected to the carrier at respective first ends of the shoulder straps and positioned in the child compartment to extend over the shoulders of the child when the child is placed on the seat portion;

an adjustment strap coupled to respective second ends of the shoulder straps; and an adjustment device mounted on the carrier and having an engaged position for engaging the adjustment strap such that the shoulder straps may be tightened on the child by exerting a force only on the adjustment strap, the adjustment device inhibiting loosening of the adjustment strap and thereby inhibiting loosening of the shoulder straps on the child when the adjustment device is in the engaged position;

wherein the cross member is positioned below the seat portion and mounts the adjustment device.

11. A child carrier as set forth in claim 10 wherein the child safety harness is a five-point harness.

12. A child carrier as set forth in claim 11 wherein a shoulder pad and a back pad are mounted on said shoulder straps, the back pad being adjustable vertically to contact the upper back of the child.

13. A child carrier as set forth in claim 10 wherein the adjustment device includes a release strap connected to the adjustment device and movable to release the adjustment strap from engagement with the adjustment device for loosening the shoulder straps.

14. A child carrier as set forth in claim 13 wherein the adjustment strap and the release strap extend down and away from the child compartment such that they are accessible from outside the child compartment.

15. A child carrier as set forth in claim 10 wherein the adjustment device includes a rotatable member having teeth thereon for engaging the adjustment strap when the adjustment device is in the engaged position to substantially secure the adjustment strap against movement in an upward direction and thereby prevent loosening of the shoulder straps, while allowing movement of the adjustment strap in a downward direction for allowing the shoulder straps to be tightened against the child, the adjustment device further having a released position in which the teeth are not engaged with the adjustment strap to allow movement in the upward direction and thereby allow loosening of the shoulder straps.

16. A child carrier as set forth in claim 15 wherein the adjustment strap contacts a surface when in the engaged position, the surface having a rib protruding therefrom, and in the event the child is forced abruptly against the shoulder straps, the rotatable member being capable of rotation such that more of the teeth engage the adjustment strap and such that the teeth move farther away from the rib.

17. A child carrier as set forth in claim 16 wherein the adjustment device includes a spring biasing the rotatable member toward the engaged position.

* * * * *